US005558263A

United States Patent [19]

Long

[11] Patent Number: 5,558,263

[45] Date of Patent: Sep. 24, 1996

[54] APPARATUS AND METHOD FOR NON-CONTACT ACTIVE TENSIONING AND STEERING OF MOVING WEBS

[75] Inventor: Michael Long, Rochester, N.Y.

[73] Assignee: Eastman Kodak Company, Rochester, N.Y.

[21] Appl. No.: 280,693

[22] Filed: Jul. 26, 1994

[51] Int. Cl.[6] ..... B65H 23/035

[52] U.S. Cl. ..... 226/114; 226/15; 226/21; 226/199

[58] Field of Search ..... 226/114, 21, 15, 226/18, 109, 197, 199, 44, 22, 23; 101/244, 228

[56] References Cited

U.S. PATENT DOCUMENTS

| | | | |
|---|---|---|---|
| 2,685,417 | 8/1954 | Bartelson . | |
| 2,714,268 | 8/1955 | Battey | 41/7 |
| 2,989,265 | 6/1961 | Selsted | 226/21 X |
| 3,107,036 | 10/1963 | Richards et al. | 226/23 X |
| 3,453,847 | 7/1969 | Romanaukas | 226/22 X |
| 3,592,372 | 7/1971 | James et al. | 226/22 |
| 3,599,849 | 8/1971 | Callan | 226/22 |
| 3,606,120 | 9/1971 | Wyatt et al. | 226/22 |
| 3,912,145 | 10/1975 | Meihofer | 226/44 |
| 4,069,959 | 1/1978 | Bartell et al. | 226/21 |
| 4,182,472 | 1/1980 | Peekna | 226/97 |
| 4,496,113 | 1/1985 | Dawson . | |
| 4,598,849 | 7/1986 | Frye et al. | 226/21 |
| 5,174,096 | 12/1992 | Fukuda | 226/21 X |

FOREIGN PATENT DOCUMENTS

| | | | |
|---|---|---|---|
| 45-37216 | 11/1970 | Japan | 226/21 |

OTHER PUBLICATIONS

Technical Brochure dated Apr. 1991, by the Kohler Coating Machinery Corp., Greentown, OH 44630 USA.

*Primary Examiner*—John P. Darling
*Attorney, Agent, or Firm*—Susan L. Parulski

[57] ABSTRACT

A moving web in a conveyance machine is tensioned and steered without contact of the web to the machine a pair of parallel air bars in a single moveable frame which is adapted to pivot controllably about two intersecting orthogonal axes in a plane through the air bars. Separate feedback control systems monitor the tension and position of the web and adjust the orientation of the frame about each axis to adjust tension and lateral position of the web independently and continuously. Additional fixed air bars on opposite sides of the web in the web path between the moveable air bars provide high and unvarying web wrap angles on the moveable air bars to increase the tension and steering operating range and sensitivity. An additional moveable air bar is provided downstream of the pair of moveable air bars and is adapted to pivot controllably about another axis orthogonal to the direction of the tensioning and steering axes whereby the axial direction of the moving web can be changed.

32 Claims, 5 Drawing Sheets

APPARATUS AND METHOD FOR NON-CONTACT ACTIVE TENSIONING AND STEERING OF MOVING WEBS

FIELD OF THE INVENTION

The invention concerns apparatus and methods for conveying moving webs, more particularly for tensioning and for steering such webs, and most particularly for simultaneously tensioning, steering, and redirecting moving webs without contact with such webs.

BACKGROUND OF THE INVENTION

Machines which convey webs typically include a number of sequential process sections, for example, a photographic film or paper coating machine may have several coating sections, setting sections, and drying sections operative upon one or both sides of a web during a single pass of a web through the machine. Typically, each process section has its own web tension regime and benefits from being isolated in tension from the sections immediately preceding and succeeding it.

In order for a web to move smoothly through such a machine, and to unwind into and wind out of the machine, the web must be under tension at all times. However, many of the conveyance elements in a machine, especially rollers, exert inertial drag on a web, and after passage over many rollers a web will exhibit a loss in tension. Therefore, drive rollers which are responsive to tension sensors are included at intervals through the machine to change or restore tension to a selected level. Thus there may be a drive roller at the end of one section and/or another drive roller at the start of the next section.

Instabilities in web tension between these drive rollers require a dynamic means to variably lengthen or shorten the web path. Such means and its action between tension-restoring machine elements is referred to herein as "tensioning." Typically, this is provided by a device in the web path consisting of two rollers mounted parallel to each other on a common frame, with the first side of the web fading one roller and the second side of the web facing the other roller. The frame pivots about an axis parallel to and midway between the rollers and transverse to the direction of web advance in order to accumulate or pay out web as needed. A torsion device acting about the axis applies a couple to the frame, which tensions the web variably in response to a web tension sensing device. U.S. Pat. Nos. 2,685,417; 2,714,268; and 4,496,113 all show web tensioning devices comprising two parallel rollers rotatable about an axis that is between and parallel to the roller axes for absorbing and releasing web material to control tension.

In tile conveyance of a web, there also exists a need to position the web controllably in the cross-web direction, sometimes repetitively, through a machine. Without such control, a web will wander laterally in a machine due to the cumulative effect of minute misalignments of conveyance components and variations in the straightness and planarity of the web itself. Alternately, succeeding sections of the machine may not be co-linear, through design or error. The lateral positioning of a moving web in a web conveyance machine is herein referred to as "steering."

Steering is typically accomplished by pivoting a frame carrying rollers, similar to the tensioning apparatus just described, about an axis in the plane and direction of the incoming web and tangential to the first roller in the frame. Such as device is disclosed in U.S. Pat. No. 4,069,959.

Pivoting this frame displaces the outgoing web laterally, but introduces, and in fact requires, a twist in both the incoming and outgoing webs. The device serves as a steering device for a web when coupled to a downstream web lateral position sensor and an appropriate actuator and feedback system.

Twist in the incoming and outgoing webs in the machine may be undesirable. One approach in dealing with twist has been to isolate twist from the main web conveyance by leading the web past a high-wrap fixed roller, around a pair of parallel air conveyance elements commonly known as "air bars" which are mounted in a frame pivotable about an axis orthogonal to the axis of the first air bar, and past a second high-wrap fixed roller. Such a device is available from The Kohler Coating Machinery Corp., Greentown, Ohio, U.S.A.

All of these prior tension isolation and steering devices suffer from loss of web traction at high web speeds due to entrainment of a thin layer of air between the rollers and the web. The loss of web traction results in a reduction in steering control and is especially troublesome for webs having low-friction coatings. Prior art devices require separate apparatus for tensioning and for steering, leading to large, space-consuming, expensive installations. Prior art devices also require very precise alignment between the rollers in the tensioning and steering frames, as well as between the frames and adjacent upstream or downstream rollers, to avoid creasing, scratching, or scuffing of webs and especially very thin webs. Such alignment is difficult and expensive to provide, for example, in applications in which rapid changeover or maintenance is required between product runs. Failure to provide such alignment in prior art conveyance machines can result in damaged or defective product, increased manufacturing cost, and decreased customer satisfaction.

SUMMARY OF THE INVENTION

The apparatus and methods of the invention are useful for providing controllably variable web tension and dynamic web guidance or steering within a web conveyance machine. Air conveyance bars are necessarily used in the moveable apparatus and methods of the invention to convey the web. Air bars do not contact the web, but rather the web rides on a cushion of low-velocity air emitted continuously by the air bar. Air bars allow another degree of freedom not possible with roller conveyors, that of helical movement of the web as it passes around the bar. A web moving helically around a roller must move laterally as well as forward, thereby scrubbing the web on the roller surface and causing scratches on the web. Roller conveyance must have no relative motion in any direction between the roller and the web, whereas motion of the web in any direction parallel to the surface of an air bar is permissible. It is this freedom which permits the apparatus and methods of the instant invention.

A pair of parallel, spaced apart air bars is provided, having first and second axes, respectively, and being generally transverse to the web path. The web engages the first air bar in a first axial direction and is wrapped through an angle of at least about 90 degrees along each air bar, but having opposite web surfaces facing the first and second air bars, respectively (known as an "S-wrap" web path). Preferably, the machine section comprising the invention has drive rollers at either end of the web path through the section. The drive rollers, typically known as "suction feed rollers," grip the web by means of vacuum provided internally and ported to the outer surface of the roller. The air bars remain with their axes parallel to each other at all times, but may be pivoted about a third axis between and parallel to the first and second air bar axes whereby the web path is shortened or lengthened controllably to vary the tension in the web. Simultaneously, the air bars may also be pivoted about a fourth axis orthogonal to the third axis, whereby the web is steered to the right or left of, but parallel to, its former path, that is, in the same axial direction. Preferably, the air bars are rigidly mounted in parallel on a sturdy frame, which frame is adapted to pivot simultaneously about the third and fourth axes as described.

Alternatively, two frames can be provided, one larger than and surrounding the other, the two frames being connected in gimbal relationship such that one frame provides the pivotal motion required for steering and the other provides the pivotal motion required for tensioning. Either of the larger or smaller frames can provide either function.

In fixed relationship to the conveyance machine may be provided two additional air bars, mounted so as to define a double "z-shaped" web path through the device, as will be described in greater detail with drawings hereinbelow. The additional air bars are mounted in the web path between the pivotable air bars to increase the web wrap angle on each of the tensioning/steering air bars to a fixed, high value, in the range of about 30 to 210 degrees, preferably about 180 degrees.

In the web path following the second tensioning/steering air bar is an additional air bar, disposed to pivot at its center about a fifth axis tangent to the air bar at the entry point of the incoming web to the air bar and orthogonal to both the steering axis and the tensioning axis. Pivoting this additional air bar serves to redirect the web in a direction not parallel to the previous web path, that is, in a different axial direction, as might be required for entry of the web to the next process section.

It is a principal object of the invention to provide apparatus and method for tensioning and steering of a web without contact of the apparatus with the web.

It is a further object of the invention to provide apparatus and method for simultaneous tensioning and steering of a web without contact of the apparatus with the web by means of a pair of air bars in a single frame which can be pivoted about two orthogonal axes.

It is a still further object of the invention to provide apparatus and method for simultaneous tensioning, steering, and redirecting of a web without contact of the apparatus with the web.

It is a still further object of the invention to provide apparatus and method for highly controlled tensioning, steering, and redirecting of a web which does not require high precision in alignment of conveyance elements.

BRIEF DESCRIPTION OF THE DRAWINGS

The foregoing and other objects, features, and advantages of the invention will be apparent from the following more particular description of the preferred embodiments of the invention, as illustrated in the accompanying drawings in which.

DETAILED DESCRIPTION OF THE INVENTION

Figure 1:
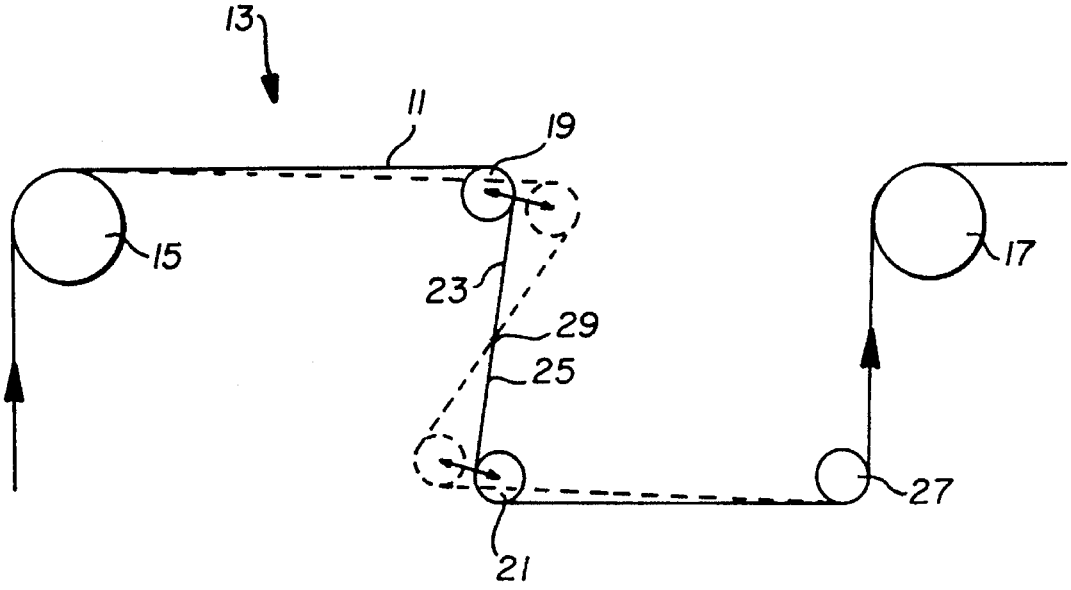
FIG. 1 is a simplified schematic cross-section of an apparatus in accordance with the invention, showing the path of a web between two isolating suction feed rollers and around moveable air bar conveyance elements for tensioning, steering, and redirecting the web.

The following is a detailed description of the preferred embodiments of the invention, reference being made to the drawings in which the same reference numerals identify the same elements of structure in each of the several figures.

The basic web path according to the invention is shown in FIG. 1. Web 11 is provided from a source (not shown) and passes along a conveyance machine frame (also not shown). Web 11 enters a section 13 of the conveyance machine wherein the web is to be steered, tensioned, and redirected. Section 13 is tension-isolated from machine sections upstream and downstream by suction feed rollers 15 and 17, respectively. Web 11 passes in an S-wrap over first and second air bars 19 and 21 at substantially equal first and second wrap angles, respectively, a first side 23 of web 11 facing first air bar 19, and a second side 25 of web 11 facing second air bar 21. The surfaces of air bars 19 and 21 facing web sides 23 and 25 are substantially cylindrical in shape. Leaving second air bar 21, web 11 passes around third air bar 27 and exits section 13 over suction feed roller 17.

Air bars 19 and 21 are held in fixed spaced relationship from each other, with their respective longitudinal axes parallel and coplanar, and are disposed to pivot about a third axis 29 approximately midway between air bars 19 and 21 and in the plane containing their axes, which pivoting lengthens or shortens the length of the web path between suction feed rollers 15 and 17.

Figure 2:
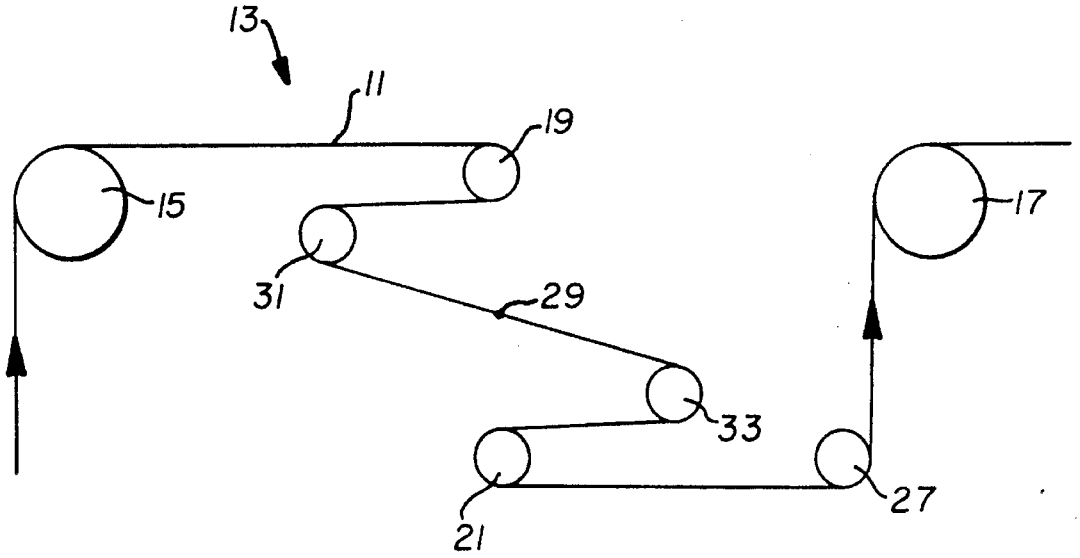
FIG. 2 is a simplified schematic cross-section showing the web path of FIG. 1 with two additional air bar conveyance elements which provide a constant wrap angle of approximately 180 degrees on each of the tensioning/steering air bars.

A web path improved over that shown in FIG. 1 is shown in FIG. 2. Air bars 31 and 33 are fixedly mounted on the machine and so disposed that fixed air bar 31 causes a wrap of about 180 degrees on pivotable air bar 19, and fixed air bar 33 causes an equal and opposite wrap on pivotable air bar 21. For any given rotation of air bars 19 and 21 about axis 29, the web path is shortened or lengthened twice as much in the web path of FIG. 2 as with the web path shown in FIG. 1. This increases the operating range of the device, as well as doubling its effect per degree of rotation.

Figure 3:
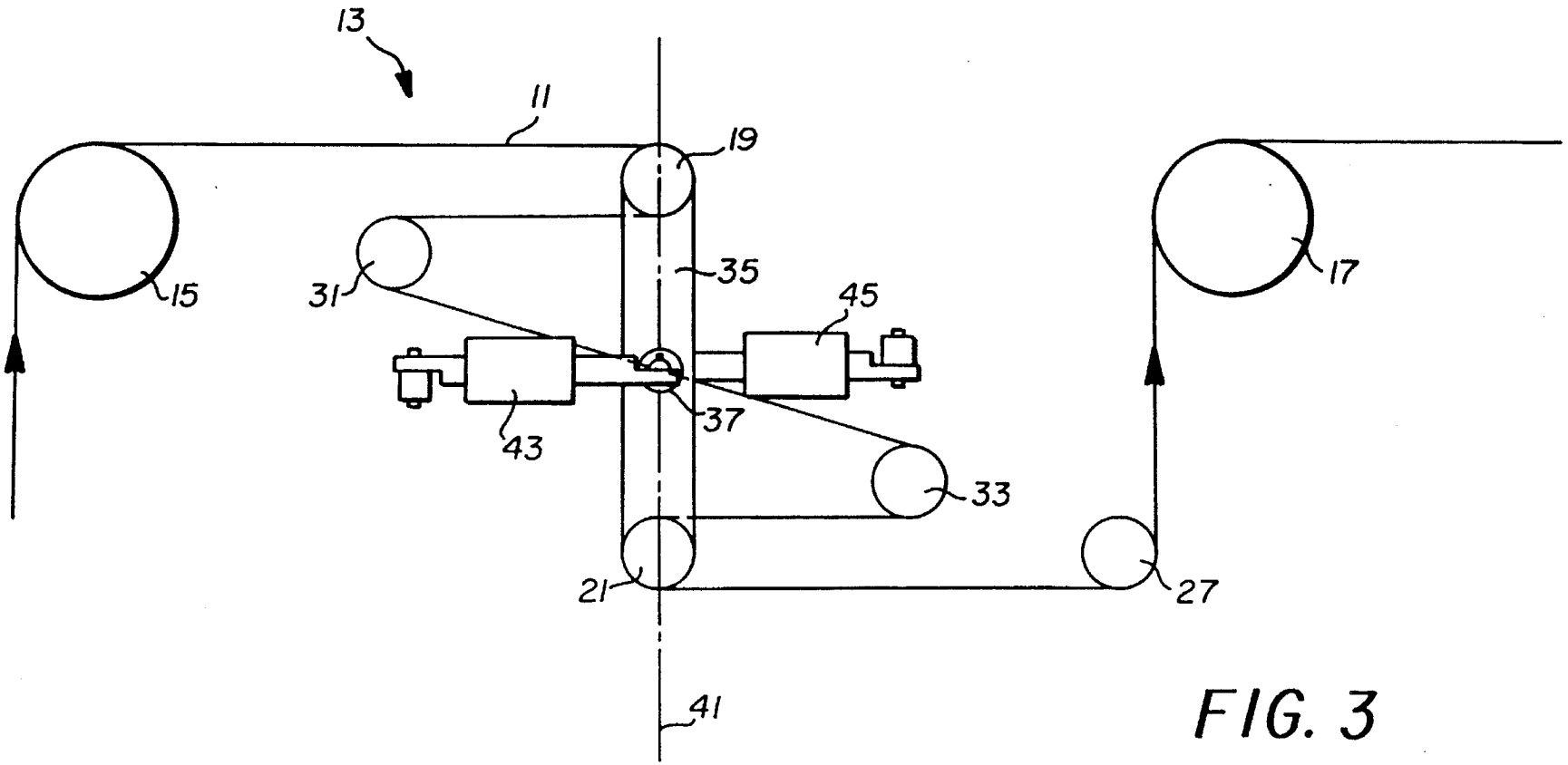
FIG. 3 is a simplified schematic cross-section of a preferred embodiment of the invention showing the web path of FIG. 2 (omitting for simplicity the air cushions between the web and the air bars as shown in previous drawings) with addition of a frame to hold the two tensioning/steering air bars in proper relationship to each other, and rotational and linear actuators operable on the frame to tension and steer the web, respectively.

In FIG. 3, operating components are added to the schematic device of FIG. 2. Frame 35 connects air bars 19 and 21 in fixed, parallel relationship and is disposed to pivot about third axis 29 by means of first torque motor 37 and second torque motor 39 (not visible in FIG. 3). Web tension is sensed by a sensor (not shown) which acts through feedback controls (also not shown) to energize motors 37 and 39 to pivot frame 35 in the appropriate direction. Motors 37 and 39 can be assisted by hydraulic actuators (not shown) operating on frame 35, to reduce the required size of motors and to improve the speed of response of the tensioning apparatus.

The invention as described thus far is an air bar version of a conventional roller-equipped tensioning frame apparatus. However, the use of air bars, as noted above, permits relative helical movement to occur between web 11 and air bars 19 and 21, respectively. Frame 35, therefore, may be equipped to cause air bars 19 and 21 to pivot about a fourth axis 41, which movement causes web 11 to move laterally (be steered) to its relative right or left as it travels between feed roll 15 and air bar 27. Linear actuators 43 and 45 are mounted on opposite sides of frame 35 and are pivotably connected at their opposite ends respectively to torque motors 37 and 39 and to the machine frame (not shown). These actuators operate equally and in parallel, and since they face in opposite directions their action serves to cause frame 35 to pivot about axis 41. The lateral position of the web downstream of air bar 21 is sensed by a conventional web sensor (not shown) and its signal is fed back via a controller (not shown) to actuators 43 and 45. Thus, frame 35 may be adapted to pivot controllably and simultaneously about both axis 29 and axis 41, thereby both tensioning and steering weld 11 simultaneously. The plane of the web between feed roller 15 and air bar 19, and between air bar 21 and third air bar 27, undergoes no twist, as would otherwise occur with prior art roller-equipped steering frames.

Figure 4:
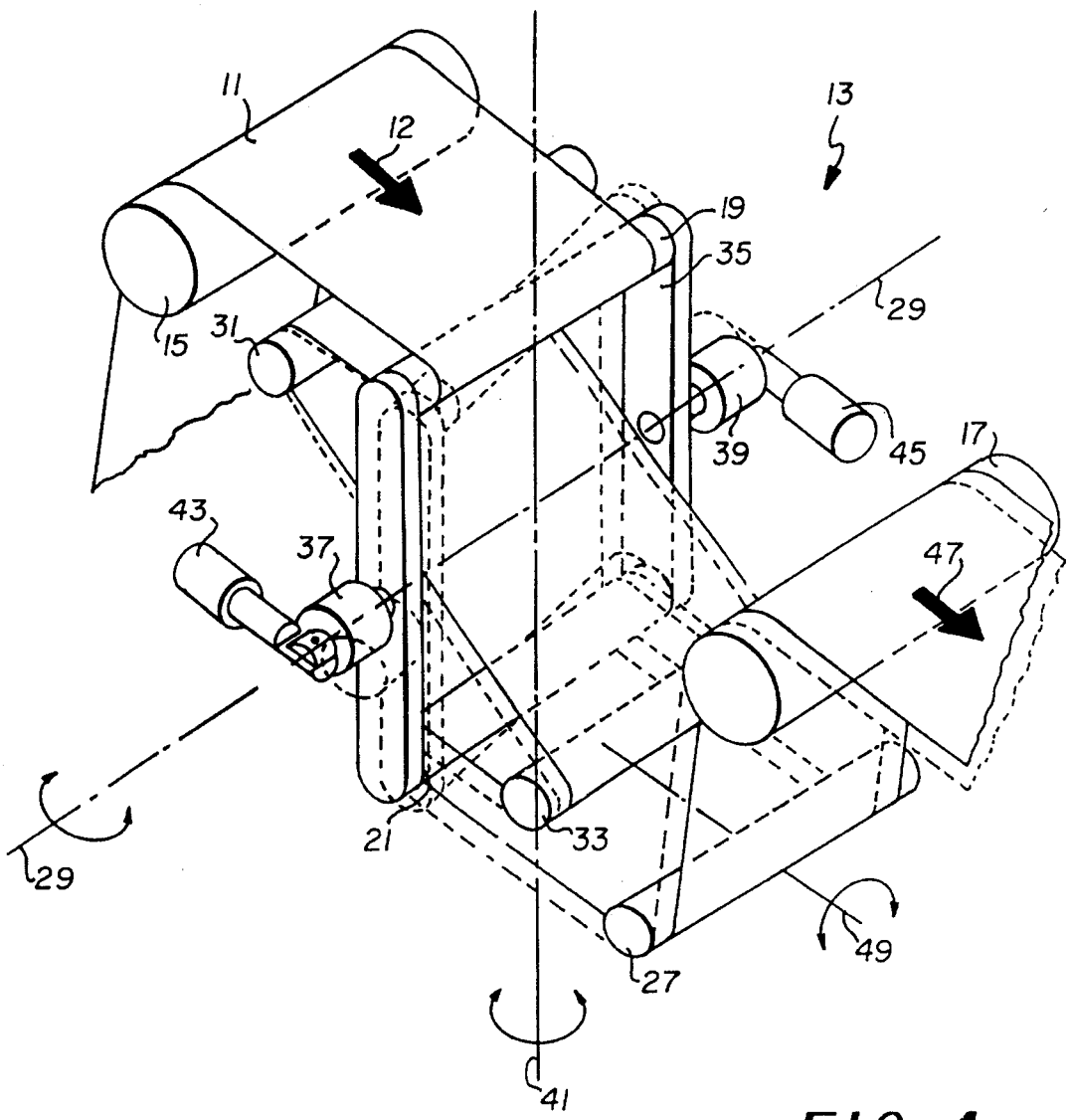
FIG. 4 is an isometric view of the apparatus shown schematically in FIG. 3, showing the steering action of the linear actuators on the frame in phantom lines.

FIG. 4 shows an isometric view of the preferred embodiment shown in cross-section in FIG. 3. The steering action of linear actuators 43 and 45 on frame 35, and the resulting lateral displacement of web 11, is shown in phantom outline.

In the next process downstream of machine section 13, the web may require a second axial direction 47 which differs from first axial direction 12. The rotations previously described about axes 29 and 41 serve only to alter the length of the web path and/or to change its lateral position. Its direction leaving air bar 21, however, is strictly parallel to its direction entering air bar 19. To change the axial direction of the web, air bar 27 is adapted to pivot about a fifth axis 49 which is tangential to air bar 27 in the plane of the entering web and orthogonal to axis 41. The pivoting mechanism, comprising a conventional frame, actuator, position sensor, and feedback controls, is not shown. Pivoting air bar 27 does introduce a twist into web 11, but the twist is unimportant, since it is not a large twist associated with steering means, but instead is quite small, serving to accommodate alignment errors.

Figure 5:
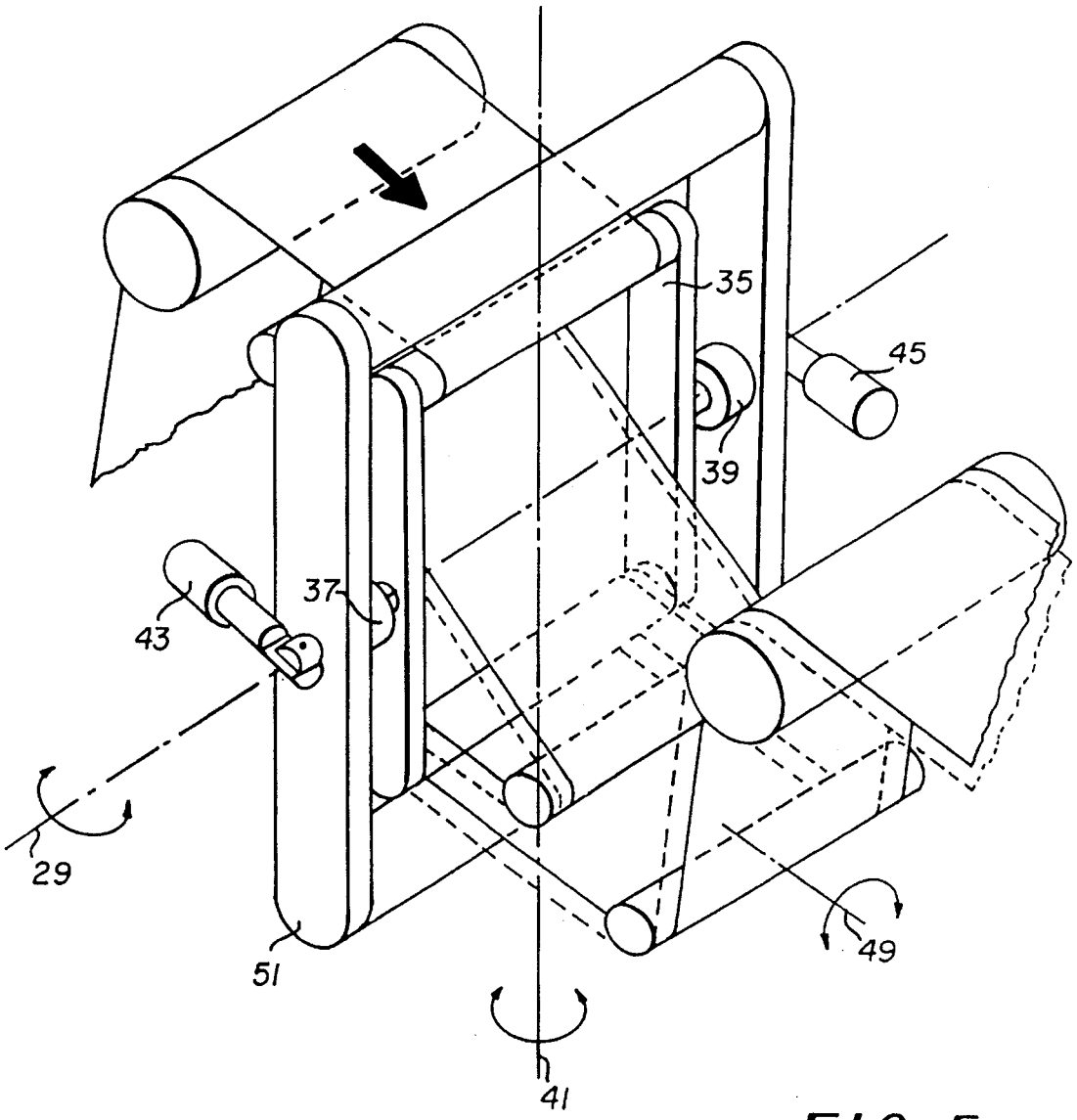
FIG. 5 is an isometric view of an alternate embodiment of the invention wherein two separate frames in gimbal relationship are provided for tensioning and steering, tensioning being provided by an inner frame and steering being provided by an outer frame.

An alternative embodiment of the invention is shown in FIG. 5. Instead of driving frame 35 to perform both the tensioning and steering motions, it may sometimes be desirable to separate the two. An inner frame is shown, like frame 35 in the previous embodiment, and the web path and operating axes are unchanged, but frame 35 is surrounded by an outer frame 51 through which the web passes. The inner and outer frames taken together constitute a gimbals for the web. Outer frame 51 is adapted with linear actuators to perform the steering function by causing inner frame 35 to pivot about only axis 41. Inner frame 35 is adapted with torque motors connecting it along axis 29 to outer frame 51 to perform the tensioning function by causing frame 35 to pivot about only axis 29 within frame 51.

Figure 6:
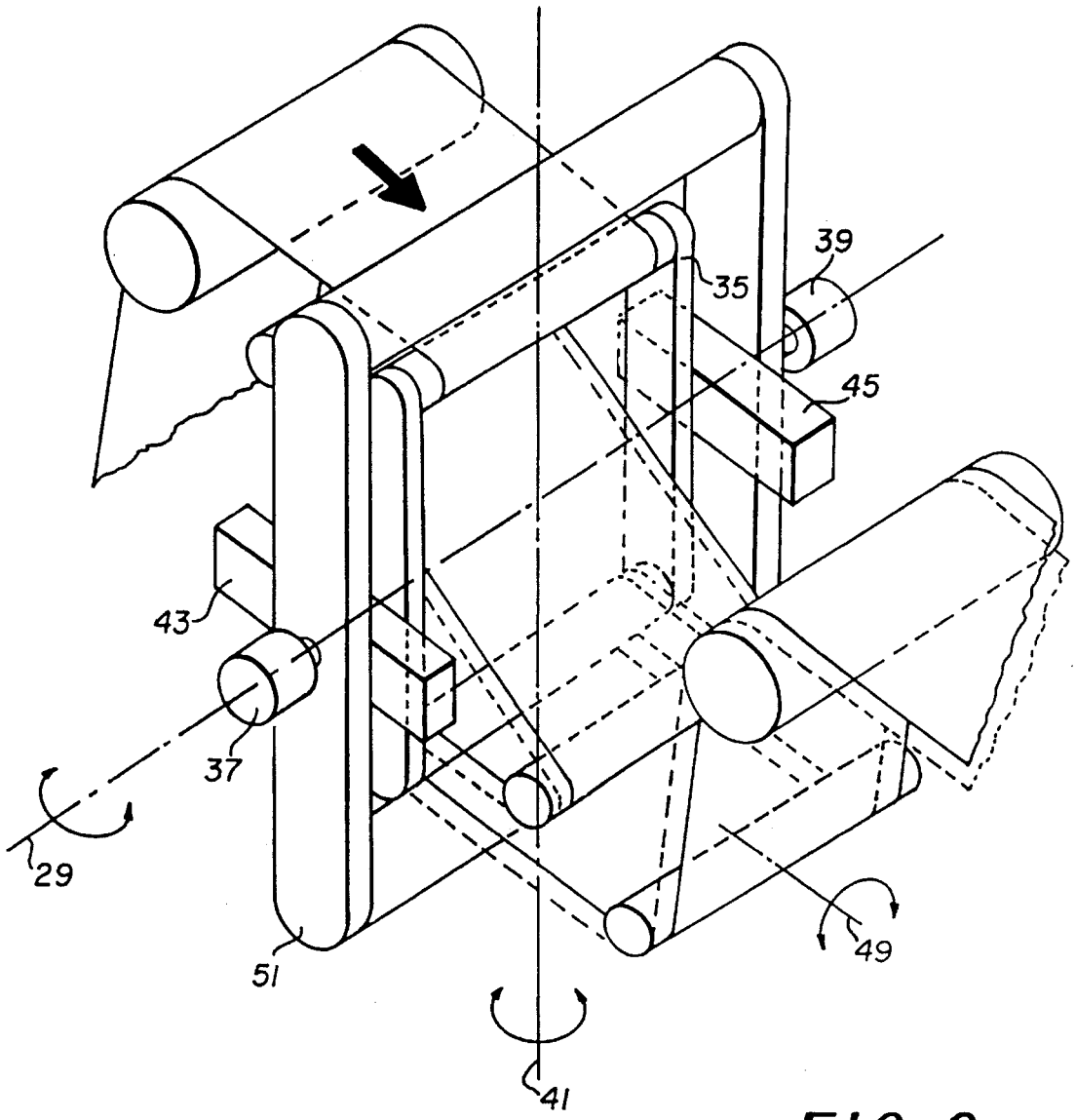
FIG. 6 is an isometric view of another alternate embodiment of the invention similar to the embodiment of FIG. 5, wherein steering is provided by an inner frame and tensioning is provided by an outer frame.

Another alternative embodiment of the invention is shown in FIG. 6. This embodiment resembles that shown in FIG. 5, except that the steering and tensioning functions have been switched between the inner and outer frames. Again, the axes and the web path are unchanged from the preferred embodiment shown in FIG. 4.

While my invention has been shown and described with reference to particular embodiments thereof, those skilled in the art will understand that other variations in form and detail may be made without departing from the scope and spirit of my invention.

PARTS LIST

11 web
12 first axial direction of web
13 section of conveyance machine
15 upstream suction feed roller
17 downstream suction feed roller
19 first air bar
21 second air bar
23 first web side
25 second web side
27 third air bar
29 third axis
31 first z-wrap air bar
33 second z-wrap air bar
35 frame
37 first torque motor
39 second torque motor
41 fourth axis
43 first linear actuator
45 second linear actuator
47 second axial direction of web
49 fifth axis
51 outer frame

What is claimed is:

1. Apparatus for conveying a web, comprising:

a) a machine frame;

b) a source of web material having first and second sides, said web material passing along said machine frame;

c) a first air bar having a first substantially cylindrical surface and a first axis, and being pivotably disposed on said machine frame, said first web side being wrapped at least partially along said first cylindrical surface through a first wrap angle;

d) a second air bar having a second substantially cylindrical surface and a second axis, said second air bar being spaced apart from said first air bar and said second axis being parallel to said first axis, and being pivotably disposed on said machine frame, said second web side being wrapped at least partially along said second cylindrical surface through a second wrap angle;

e) means for pivoting said first and second air bars in fixed relative relationship about a third axis orthogonal to said first and second axes, said third axis being in or parallel to a plane through said first and second axes and substantially orthogonal to said first and second axes, to steer said web through said apparatus; and f) means for drawing said web through said apparatus.

2. Apparatus according to claim 1 wherein said first wrap angle is numerically equal to said second wrap angle.

3. Apparatus according to claim 1 wherein said first and second air bars are further controllably adapted to pivot about a fourth axis substantially parallel to and between said first and second axes to vary the tension of said web in said apparatus.

4. Apparatus according to claim 1 further comprising first and second fixed air bars having substantially cylindrical surfaces in the web path between said first and second pivotable air bars on opposite sides respectively of the plane through said first and second axes, said second web side being wrapped at least partially along said first fixed air bar cylindrical surface and said first web side being wrapped at least partially along said second fixed air bar cylindrical surface, to provide values of each of said first and second wrap angles between 30 and 210 degrees.

5. Apparatus according to claim 1 further comprising first and second fixed air bars in the web path between said first and second pivotable air bars on opposite sides respectively of the plane through said first and second axes, said second web side being wrapped at least partially along said first fixed air bar and said first web side being wrapped at least partially along said second fixed air bar, to provide values of each of said first and second wrap angles between 30 and 210 degrees.

6. Apparatus according to claim 1 further comprising:

a) a third pivotable air bar downstream of said second pivotable air bar, said third air bar having a substantially cylindrical surface and being generally parallel to said first and second pivotable air bars; and b) means for pivoting said third air bar about a fifth axis orthogonal to said third axis, to change the axial direction of said web, said fifth axis being included in the plane of the web entering said third air bar.

7. Apparatus according to claim 1 wherein said means for pivoting comprises a first supporting frame disposed on said machine frame on which said first and second air bars are rigidly mounted, said first supporting frame being adapted to pivot controllably about said third axis.

8. Apparatus according to claim 7 wherein said first supporting frame is further controllably adapted to pivot about a fourth axis substantially parallel to said first and second axes to vary the tension of said web in said apparatus.

9. Apparatus according to claim 8 further comprising first and second fixed air bars having substantially cylindrical surfaces in the web path between said first and second pivotable air bars on opposite sides respectively of the plane through said first and second axes, said second web side being wrapped at least partially along said first fixed air bar cylindrical surface and said first web side being wrapped at least partially along said second fixed air bar cylindrical surface, to provide values of each of said first and second wrap angles between 30 and 210 degrees.

10. Apparatus according to claim 9 wherein the values of said first and second wrap angles are essentially unvarying with pivoting of said first frame about said fourth axis.

11. Apparatus according to claim 9, further comprising:

a) a third air bar downstream of said second air bar, said third air bar having a substantially cylindrical surface and being generally parallel to said first and second air bars; and b) means for pivoting said third air bar about a fifth axis orthogonal to said third axis, to change the axial direction of said web.

12. Apparatus according to claim 8 further comprising first and second fixed air bars in the web path between said first and second pivotable air bars on opposite sides respectively of the plane through said first and second axes, said second web side being wrapped at least partially around said first fixed air bar and said first web side being wrapped at least partially around said second fixed air bar, to provide values of each of said first and second wrap angles between 30 and 210 degrees.

13. Apparatus according to claim 7, further comprising:

a) a second supporting frame pivotably supporting said first supporting frame and said means for pivoting said first frame about said third axis; and b) means for pivoting said second supporting frame about a fourth axis substantially parallel to said first and second axes to vary the tension of the web in said apparatus.

14. Apparatus for conveying a web, comprising:

a) a machine frame;

b) a source of web material having first and second sides, said web material passing along said machine frame;

c) a first air bar having a first substantially cylindrical surface and a first axis, and being pivotably disposed on said machine frame, said first web side being wrapped at least partially along said first cylindrical surface through a first wrap angle;

d) a second air bar having a second substantially cylindrical surface and a second axis, said second air bar being spaced apart from said first air bar and said second axis being parallel to said first axis, and being pivotably disposed on said machine frame, said second web side being wrapped at least partially along said second cylindrical surface through a second wrap angle;

e) means for pivoting said first and second air bars in fixed relative relationship about a third axis parallel to and between said first and second axes, to tension said web through said apparatus; and f) means for drawing said web through said apparatus.

15. Apparatus according to claim 14 wherein said first wrap angle is numerically equal to said second wrap angle.

16. Apparatus according to claim 14 wherein said first and second air bars are further controllably adapted to pivot about a fourth axis in or parallel to a plane through said first and second axes and substantially orthogonal to said first, second, and third axes, to steer said web through said apparatus.

17. Apparatus according to claim 14 further comprising first and second fixed air bars having substantially cylindrical surfaces in the web path between said first and second pivotable air bars on opposite sides respectively of the plane through said first and second axes, said second web side being wrapped at least partially along said first fixed air bar cylindrical surface and said first web side being wrapped at least partially along said second fixed air bar cylindrical surface, to provide values of each of said first and second wrap angles between 30 and 210 degrees.

18. Apparatus according to claim 14 further comprising first and second fixed air bars in the web path between said first and second pivotable air bars on opposite sides respectively of the plane through said first and second axes, said second web side being wrapped at least partially around said first fixed air bar and said first web side being wrapped at least partially around said second fixed air bar, to provide values of each of said first and second wrap angles between 30 and 210 degrees.

19. Apparatus according to claim 14 further comprising:

a) a third air bar downstream of said second air bar, said third air bar having a substantially cylindrical surface and being generally parallel to said first and second air bars; and b) means for pivoting said third air bar about a fifth axis orthogonal to said third axis, to change the axial direction of said web.

20. Apparatus according to claim 14 wherein said means for pivoting comprises a first supporting frame on which said first and second air bars are rigidly mounted, said first supporting frame being adapted to pivot controllably about said third axis.

21. Apparatus according to claim 20 wherein said first supporting frame is further controllably adapted to pivot about a fourth axis substantially parallel to said first and second axes to vary the tension of said web in said apparatus.

22. Apparatus according to claim 21 further comprising first and second fixed air bars having substantially cylindrical surfaces in the web path between said first and second pivotable air bars on opposite sides respectively of the plane through said first and second axes, said second web side being wrapped at least partially along said first fixed air bar cylindrical surface and said first web side being wrapped at least partially along said second fixed air bar cylindrical surface, to provide values of each of said first and second wrap angles between 30 and 210 degrees.

23. Apparatus according to claim 22 wherein the values of said first and second wrap angles are essentially unvarying with pivoting of said first frame about said fourth axis.

24. Apparatus according to claim 22, further comprising:

a) a third air bar downstream of said second air bar, said third air bar having a substantially cylindrical surface and being generally parallel to said first and second air bars; and b) means for pivoting said third air bar about a fifth axis orthogonal to said fourth axis, to change the axial direction of said web.

25. Apparatus according to claim 21 further comprising first and second fixed air bars in the web path between said first and second pivotable air bars on opposite sides respectively of the plane through said first and second axes, said second web side being wrapped at least partially around said first fixed air bar and said first web side being wrapped at least partially around said second fixed air bar, to provide values of each of said first and second wrap angles between 30 and 210 degrees.

26. Apparatus according to claim 20, further comprising:

a) a second supporting frame pivotably supporting said first supporting frame and said means for pivoting said first supporting frame about said third axis; and b) means for pivoting said second supporting frame about a fourth axis in or parallel to a plane through said first and second axes and substantially orthogonal to said first and second axes, to steer said web through said apparatus.

27. Apparatus for conveying a web, comprising:

a) a machine frame;

b) a source of web material having first and second sides, said web material passing along said machine frame;

c) a first air bar having a first substantially cylindrical surface and a first axis, said first web side being wrapped at least partially along said first air bar surface through a first wrap angle;

d) a second air bar having a second substantially cylindrical surface and a second axis, said second web side being wrapped at least partially along said second air bar surface through a second wrap angle;

e) a supporting frame disposed on said machine frame for supporting said first and second air bars in fixed relationship with said first and second axes spaced apart and substantially parallel;

f) means for controllably pivoting said supporting frame about a third axis substantially parallel to and between said first and second axes to tension said web through said apparatus;

g) means for controllably pivoting said supporting frame about a fourth axis orthogonal to said third axis and intersecting said third axis between said first and second axes, to steer said web;

h) first and second fixed air bars having substantially cylindrical surfaces in the web path between said first and second pivotable air bars and being fixedly mounted on said machine frame on opposite sides respectively of the plane through said first and second axes, said second web side being wrapped at least partially along said first fixed air bar cylindrical surface and said first web side being wrapped at least partially along said second fixed air bar cylindrical surface, to provide values of each of said first and second wrap angles between 30 and 210 degrees; and i) means for drawing said web through said apparatus.

28. Apparatus according to claim 27 further comprising:

a) a third air bar pivotably mounted on said machine frame downstream of said second pivotably mounted air bar, said third air bar having a substantially cylindrical surface and being generally parallel to said first and second pivotably mounted air bars; and b) means for pivoting said third air bar about a fifth axis orthogonal to said fourth axis, to change the axial direction of said web.

29. In an apparatus for conveying web having first and second sides, a method for steering and tensioning said web comprising the steps of:

a) partially wrapping said web along the first and second surfaces, respectively, of first and second spaced apart air bars having first and second axes, respectively, said first side of said web facing said first surface and said second side of said web facing said second surface, said air bars being fixed in relation to one another with said first and second axes being parallel, said pair of air bars being adapted to be controllably rotated about a third axis substantially parallel to and between said first and second axes and simultaneously about a fourth axis orthogonal to said third axis and substantially parallel to or within a plane through said first and second axes;

b) driving said web through said apparatus;

c) controllably rotating said pair of air bars about said fourth axis to steer said driven web to a new lateral position; and d) controllably rotating said pair of air bars about said third axis to change the web path length to maintain tension in the web.

30. The method of claim 29 further comprising the steps of:

a) wrapping said second web side along a third cylindrical air bar having a cylindrical surface and being downstream of said second air bar; and b) pivoting said third air bar about a fifth axis orthogonal to said fourth axis, to change the axial direction of said web, said fifth axis being included in the plane of the web entering said third air bar.

31. In a method for steering and tensioning a web in a conveyance machine, wherein said web moves over first and second adjacent air bars having first and second parallel axes, respectively, wherein said axes are parallel, and wherein said web is wrapped in angles of at least 30 degrees around each of said first and second air bars, the improvement comprising pivoting said first and second air bars simultaneously about a third axis parallel to and between said first and second axes to tension the web and about a fourth axis orthogonal to said third axis to steer the web.

32. Apparatus for tensioning and steering a moving web having first and second sides without contact between the web and the apparatus, comprising:

a) a first pivotable air bar having a first substantially cylindrical surface and a first axis, said first web side being wrapped at least partially along said first cylindrical surface through a first wrap angle;

b) a second pivotable air bar spaced apart from said first air bar, having a second substantially cylindrical surface and a second axis parallel with said first axis, said web having a path between said first and second air bars causing said second web side to be wrapped at least partially along said second cylindrical surface through a second wrap angle; and c) means for simultaneously and controllably pivoting said first and second air bars together about a third axis parallel to and between said first and second axes to tension said web and about a fourth axis orthogonal to said third axis to steer said web.

* * * * *

UNITED STATES PATENT AND TRADEMARK OFFICE

CERTIFICATE OF CORRECTION

PATENT NO. : 5,558,263

DATED : Sep. 24, 1996

INVENTOR(S) :

Michael Long

It is certified that error appears in the above-indentified patent and that said Letters Patent is hereby corrected as shown below:

Title page,

Item [57], line 2, "steered without contact of the web to the machine a pair of" should read --steered without contact of the web to the machine by a pair of--

Signed and Sealed this

Twenty-fourth Day of December, 1996

*Attest:*

Bruce Lehman

BRUCE LEHMAN

*Attesting Officer*

*Commissioner of Patents and Trademarks*